US011662099B2

(12) United States Patent
Metz et al.

(10) Patent No.: US 11,662,099 B2
(45) Date of Patent: May 30, 2023

(54) ELECTRICALLY OPERATED FIREPLACE SYSTEMS AND METHODS

(71) Applicant: Solas, LLC, Newport, NH (US)

(72) Inventors: Andrew Thomas Metz, Lebanon, NH (US); David Patrick Moynihan, Grantham, NH (US)

(73) Assignee: Solas, LLC, Newport, NH (US)

( * ) Notice: Subject to any disclaimer, the term of this patent is extended or adjusted under 35 U.S.C. 154(b) by 0 days.

(21) Appl. No.: 17/540,610

(22) Filed: Dec. 2, 2021

(65) Prior Publication Data

US 2022/0170642 A1 Jun. 2, 2022

Related U.S. Application Data

(60) Provisional application No. 63/120,603, filed on Dec. 2, 2020.

(51) Int. Cl.

| | |
|---|---|
| ***F24C 7/00*** | (2006.01) |
| ***F24H 3/02*** | (2022.01) |
| ***F21S 10/04*** | (2006.01) |
| ***F24H 9/02*** | (2006.01) |
| *F21Y 115/10* | (2016.01) |

(52) U.S. Cl.

CPC ..... *F24C 7/004* (2013.01); *F21S 10/04* (2013.01); *F24H 3/022* (2013.01); *F24H 9/02* (2013.01); *F21Y 2115/10* (2016.08)

(58) Field of Classification Search

CPC .. F24H 9/02; F24H 3/022; F21S 10/04; F24C 7/004

See application file for complete search history.

(56) References Cited

U.S. PATENT DOCUMENTS

| | | | | |
|---|---|---|---|---|
| 9,429,757 | B1 * | 8/2016 | Peeri | G02B 27/0101 |
| 2009/0241386 | A1 * | 10/2009 | Abileah | G02F 1/1336 40/428 |
| 2013/0258640 | A1 * | 10/2013 | Lu | F21S 10/046 362/297 |
| 2015/0325055 | A1 * | 11/2015 | Balakrishna | H04N 13/395 348/49 |
| 2017/0285384 | A1 * | 10/2017 | Yata | G02F 1/13363 |
| 2018/0098382 | A1 * | 4/2018 | Kaylor | F24D 15/02 |
| 2018/0347818 | A1 * | 12/2018 | Birnbaum | F24C 7/004 |
| 2021/0080763 | A1 * | 3/2021 | Sulai | G02B 27/10 |
| 2021/0372627 | A1 * | 12/2021 | Walker | F21S 10/046 |
| 2022/0090751 | A1 * | 3/2022 | Van Schie | G02B 30/60 |

* cited by examiner

*Primary Examiner* — Jong-Suk (James) Lee
*Assistant Examiner* — Christopher E Dunay
(74) *Attorney, Agent, or Firm* — Grossman, Tucker, Perreault & Pfleger PLLC

(57) ABSTRACT

The present disclosure is directed to systems and methods for providing an electrically operated fireplace that includes a one or more display panels, one or more reflective surfaces inclined at an angle with respect to the one or more display panels to reflect the video images of a flame displayed by the one or more display panels. One or more filters or privacy screens are disposed proximate the one or more display panels. Beneficially, the electrically operated fireplaces disclosed herein do not require the use of moving parts, such as a rotating mirror, to provide the images of the flames. Further, since video images are used to provide the flame effect, the flame effect may be varied simply by loading a new video image into the memory portion of the control circuitry used to provide the flame display.

19 Claims, 4 Drawing Sheets

ELECTRICALLY OPERATED FIREPLACE SYSTEMS AND METHODS

CROSS-REFERENCE TO RELATED APPLICATION

The present application claims the benefit of the filing date of U.S. Provisional Application Ser. No. 63/120,603, filed Dec. 2, 2020, the entire teachings of which are hereby incorporated herein by reference.

TECHNICAL FIELD

The present disclosure relates to fireplaces, more specifically to electrically operated fireplaces.

BACKGROUND

An electrically operated fireplace may be configured as an electric heater that selectively provides a warm air output while mimicking the appearance of a conventional gas or wood fireplace. Since the warm air output of the electric fireplace may be switched off, electric fireplaces may also be used as a non-heat producing decorative pieces. Many electric fireplaces include thermostats and remote-controlled operation. Due to the lack of venting requirements, electric fireplaces are convenient and available in a variety of designs—all-in-one units, inserts for conventional fireplaces, media stands, and wall hanging electric fireplaces are available.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Although the following Detailed Description will proceed with reference being made to illustrative embodiments, many alternatives, modifications and variations thereof will be apparent to those skilled in the art.

DETAILED DESCRIPTION

The systems and methods described herein beneficially and advantageously provide a representation of an actual fireplace through the use of one or more display panels positioned below an inclined reflective surface. Images of combustion or flames displayed on the display panels are reflected by the inclined reflective surface. The relative positioning and distance between the display panels and the reflective surface provide the appearance of the flames originating at a substrate layer disposed at the base of the inclined reflective surface. The substrate may include simulated organic material such as wood or logs or may include synthetic materials such as glass or acrylic. The substrate may be illuminated using a one or more substrate light sources positioned beneath the substrate. Beneficially and advantageously, the use of bottom projection makes possible the use of a transparent back panel on the fireplace housing to provide a "see through" electrically operated fireplace. Further, a second system as described above may be mirrored on the back side of the first system to produce a two-sided, see through, electrically operated fireplace. Additionally, a third system as described above may be disposed substantially perpendicular to the first and second systems to provide a peninsula type electrically operated fireplace that provides visible flames on three sides—left side, right side and one end of the fireplace. Functionally, electrically operated fireplaces may produce a warm air output using one or more electric heaters and one or more air movers typically disposed in the base or hearth portion of the electrically operated fireplace.

An electrically operated fireplace system is provided. The system may include: one or more first display panels aligned to form a first planar display structure; one or more first reflective panels, having at least one reflective surface disposed at an angle measured with respect to the first planar display structure, the at least one reflective surface to reflect at least a portion of an image displayed by the first planar display structure; one or more first filters disposed between the first planar display structure and the and the one or more first reflective panels, the one or more first filters to selectively transmit incident visible light generated by the first planar display structure and perpendicular to the one or more first filters; and one or more first substrate light sources.

Figure 1B:
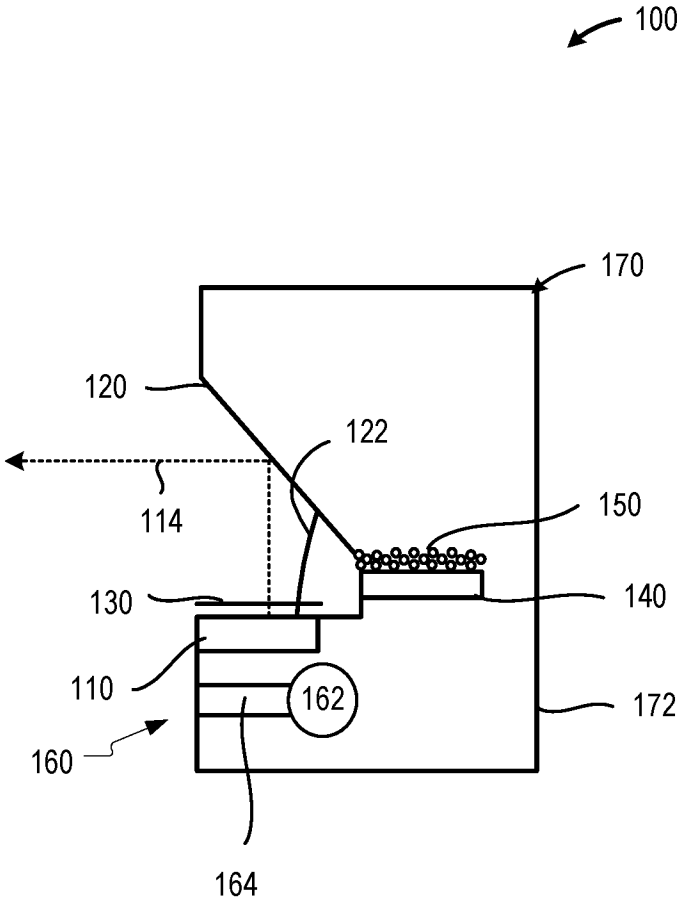
FIG. 1B is a transverse cross-sectional view along sectional line B-B in FIG. 1A, in accordance with at least one embodiment described herein.
Figure 1A:
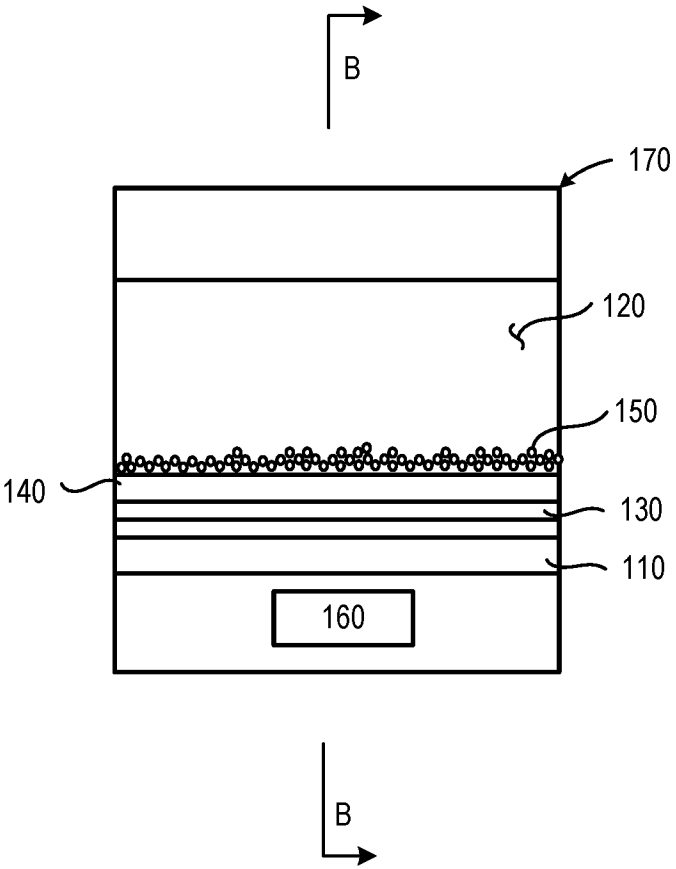
FIG. 1A is a front elevation view of an illustrative electrically operated fireplace system in accordance with at least one embodiment described herein.

FIG. 1A is a front elevation view of an illustrative electrically operated fireplace system 100 that includes one or more first display panels 110, one or more first reflective surfaces 120, one or more filters 130, one or more first substrate light sources 140, and one or more substrates 150 in accordance with at least one embodiment described herein. FIG. 1B is a transverse cross-sectional view along sectional line B-B in FIG. 1A, in accordance with at least one embodiment described herein.

Referring to both FIG. 1A and FIG. 1B, the image displayed by the one or more display panels 110 passes through one or more first filters 130 and is reflected off the one or more first reflective surfaces 120, as indicated by arrow 114. The image reflected from the one or more first reflective surfaces 120 is thus visible to individuals external to the electrically operated fireplace 100. The one or more first filters 130 are disposed proximate the one or more display panels 110 to prevent viewers from seeing the image on the one or more display panels 110. The one or more first filters 130 may permit only electromagnetic energy incident at 90° on the surface of the one or more first filters 130 to pass through the one or more first filters. The one or more first filters 130 thus allow the image from the one or more display panels to pass through the one or more first filters 130 but prevent viewers external to the electrically operated fireplace from seeing or observing the one or more display panels 110 when the sight line of the viewer is at an angle to the top surface of the one or more filters that is different from 90°.

The electrically operated fireplace may additionally include one or more substrate light sources 140 positioned beneath a natural or synthetic substrate 150 material. Beneficially, by adjusting the relative position (i.e., the vertical and/or horizontal separation) between the one or more display panels 110 and the one or more substrate light sources, images, such as "dancing flames," displayed by the display panel appear, to observers external to the electrically operated fireplace 100, to originate from the substrate material 150.

A heating system 160, including one or more air movers 162 and/or one or more heating elements 164 may be disposed in the housing at least partially enclosing the electrically operated fireplace 100. Although depicted as "below" the one or more display panels 110, in other embodiments, the heating system 160 may be positioned above or even alongside the one or more reflective surfaces 120. In such embodiments, the heating system 160 simulates the draft of warm air produced by a conventional wood or gas-burning fireplace.

A housing 170 at least partially surrounds the electrically operated fireplace 100. The housing 170 may have any physical size, shape, and/or physical configuration. In at least some embodiments, at least a portion, for example the rear portion 172 (i.e., the side of the housing transversely opposed across the width of the electrically operated fireplace 100 from the one or more first reflective surfaces 120) may include a transparent or translucent panel that permits a view through (i.e., a "see-through" view) the electrically operated fireplace 100.

The one or more display panels 110 may include any number, size, and/or configuration of light emitting display devices capable of displaying a stored image sequence, e.g., a video sequence. In at least some embodiments, control circuitry coupled to the one or more display panels 110 may synchronize or otherwise control the timing of the images displayed by the one or more display panels 110 across a plurality of adjacent, individual display panels 110.

In embodiments, the one or more display panels 110 may include one or more backlit liquid crystal display (LCD) display panels; one or more light emitting diode (LED) display panels; one or more organic LED (OLED) display panels; one or more polymer LED (PLED) display panels; and/or one or more quantum dot LED (QLED) display panels. In at least some embodiments, control circuitry communicatively coupled to the one or more display panels 110 may be used to individually or collectively adjust the color, saturation, brightness, and/or contrast some or all of the one or more display panels 110.

The one or more display panels 110 may include a plurality of display panels, each having the same or different dimensions and/or aspect ratios. In one example, the one or more display panels 110 may include a plurality of lengthwise adjacent display panels, each having a 16:9 aspect ratio and having dimensions of approximately 7 inches in length by 4 inches in width. In at least some embodiments, the one or more display panels 110 may include a plurality of display panels that all lay in the same plane (i.e., are coplanar) thereby forming a planar display structure.

The one or more reflective surfaces 120 may include any number and/or combination of panels useful for reflecting the images generated by the one or more display panels 110. In some embodiments, the one or more reflective surfaces 120 may include the surface of a glass panel, an acrylic panel, a polycarbonate panel, or any other similarly smooth, transparent, or nearly transparent panel. In embodiments, the one or more reflective surfaces 120 may include the surface of an opaque panel, for example a black glass panel.

The one or more reflective surfaces 120 may be disposed at any angle 122 measured with respect to the plane of the light emitting surface of one or more display panels 110 and/or the light emitting surface(s) of a planar display structure formed by a plurality of display panels 110.

In embodiments, the one or more reflective surfaces 120 may be disposed at an angle 122 of: about 30° to about 60°; about 35° to about 55°; or about 40° to about 50° measured with respect to the plane of the light emitting surface of the one or more display panels 110 and/or the light emitting surface(s) of the planar display structure formed by a plurality of display panels 110. In at least one embodiment, the one or more reflective surfaces 120 may be disposed at an angle 122 of about 45° measured with respect to the plane of the light emitting surface of the one or more display panels 110 and/or the light emitting surface(s) of the planar display structure formed by a plurality of display panels 110.

In some embodiments, all or a portion of the one or more reflective surfaces 120 may be tinted or colored. For example, in some embodiments, at least the portion of the one or more reflective surfaces 120 that reflect the images produced by the one or more display panels 110 may be tinted with a blue tint.

The one or more filters 130 may be disposed proximate the one or more display panels 110. The one or more filters 130 permit the transmission of light incident on a bottom surface of the one or more filters 130 at an angle of 90° and block the transmission of incident light on the bottom surface at angles other than 90°. The one or more filters 130 thus prevent an observer external to the electrically operated fireplace 100 from directly observing the images produced by the one or more display panels 110 from a line of sight at an angle other than 90°. In at least some embodiments, the one or more filters 130 may include one or more blind louver type privacy filters bonded to the light emitting surface of each of the display panels included in the one or more display panels 110. In some embodiments, the one or more filters 130 may include a 2-way privacy filter that prevents observation along an axis transverse to the one or more display panels 110. In other embodiments, the one or more filters 130 may include a 4-way privacy filter that prevents observation of the display panel surface along both a transverse axis and a longitudinal axis of each of the display panels included in the plurality of display panels 110. In at least some embodiments, the brightness of some or all of the one or more display panels may be increased to compensate for the attenuation caused by the one or more filters 130.

The one or more substrate light sources 140 may be disposed proximate or a short distance away from the one or more display panels 110. In embodiments, the light emitting surface of one or more substrate light sources 140 may be substantially co-planar with the light emitting surface of one or more display panels 110. In other embodiments, the light emitting surface of one or more substrate light sources 140 may be substantially parallel to the light emitting surface of one or more display panels 110 and distance above or below the light emitting surface of one or more display panels 110. For example, the light emitting surface of one or more substrate light sources 140 may be disposed substantially parallel to and above the planar display structure formed by the one or more display panels 110 by a distance of about: 0.25 inches or less; 0.50 inches or less; 0.75 inches or less; 1 inch or less; 1.5 inches or less; or 2 inches or less.

The one or more substrate light sources 140 may include any type of light source including but not limited to incandescent light sources, halogen light sources, liquid crystal display (LCD) light sources, light emitting diode (LED) light sources, or combinations thereof. In embodiments, the one or more substrate light sources 140 may have an orange and/or red output to simulate the characteristic colors associated with a burning fuel source. In embodiments, the one or more substrate light sources 140 may have a variable output intensity to simulate the "flicker" associated with a combustion process.

In embodiments, a substrate media 150 may be disposed on or about all or a portion of the one or more substrate light sources 140. The substrate media 150 may include one or more transparent substrate media types, one or more translucent substrate media types, one or more opaque substrate media types, or combinations thereof. In embodiments, the substrate media 150 may include an inert media such as synthetic wood, glass, acrylic, or combinations thereof. In at least some embodiments, the substrate media 150 may serve to diffuse or more evenly space the light produced by the one or more substrate light sources 140.

The heater assembly 160 includes at least one air mover 162 and at least one heating element 164 to deliver a flow of warm air to the external area surrounding the electrically operated fireplace 100. In embodiments, the at least one air mover 162 may include one or more centrifugal fans. The at least one air mover 162 may have any volumetric output. In embodiments, the volumetric output from each of the at least one air movers 162 may be about: 50 standard cubic feet per minute (SCFM) or greater; 100 SCFM or greater; 150 SCFM or greater; 200 SCFM or greater; 250 SCFM or greater; 300 SCFM or greater; or 400 SCFM or greater. In embodiments, the at least one heating element 164 may include one or more electric resistance heating elements, one or more ceramic heating elements, one or more quartz heating elements, or combinations thereof. Each of the at least one heating elements 164 may have the same or different thermal output. In embodiments, each of the at least one heating elements 164 may have a thermal output of about: 100 watts (W) or less; 300 W or less; 500 W or less; 1000 W or less; 1500 W or less; 2000 W or less; or 5000 W or less.

The housing 170 may include a multisided housing having an aperture formed in at least one sidewall to permit the observation of the reflected image provided by the one or more display panels 110 and the one or more reflective surfaces 120. In some embodiments, the sidewall 172 transversely opposite the sidewall having the aperture of the housing may be transparent to provide a "see-through" electrically operated fireplace 100. In embodiments, all or a portion of the housing 170 may be fabricated using metal, plastic, fiberglass, or combinations thereof. The housing 170 may have any dimensions, shape or configuration. In at least some embodiments, the end walls 174 and 176 of the housing 170 may include multi-piece assembles including an internal wall and an external wall. In embodiments, the internal end wall may include one or more grooves, detents, or similar surface features to accommodate the insertion of an edge of the one or more reflective surfaces 120.

Figure 2A:
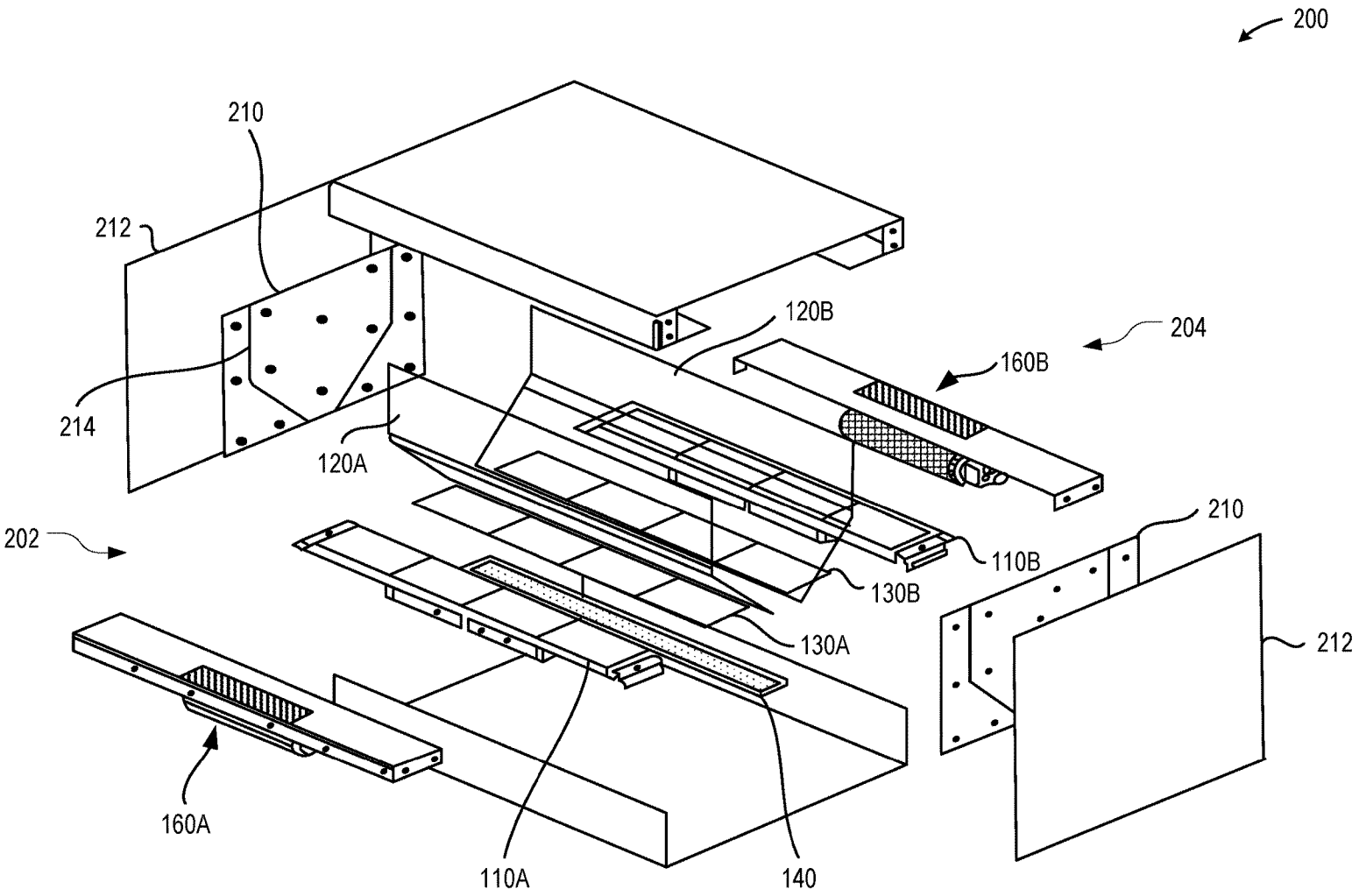
FIG. 2A is an exploded perspective view of an illustrative two-sided electrically operated fireplace in accordance with at least one embodiment described herein.
Figure 2B:
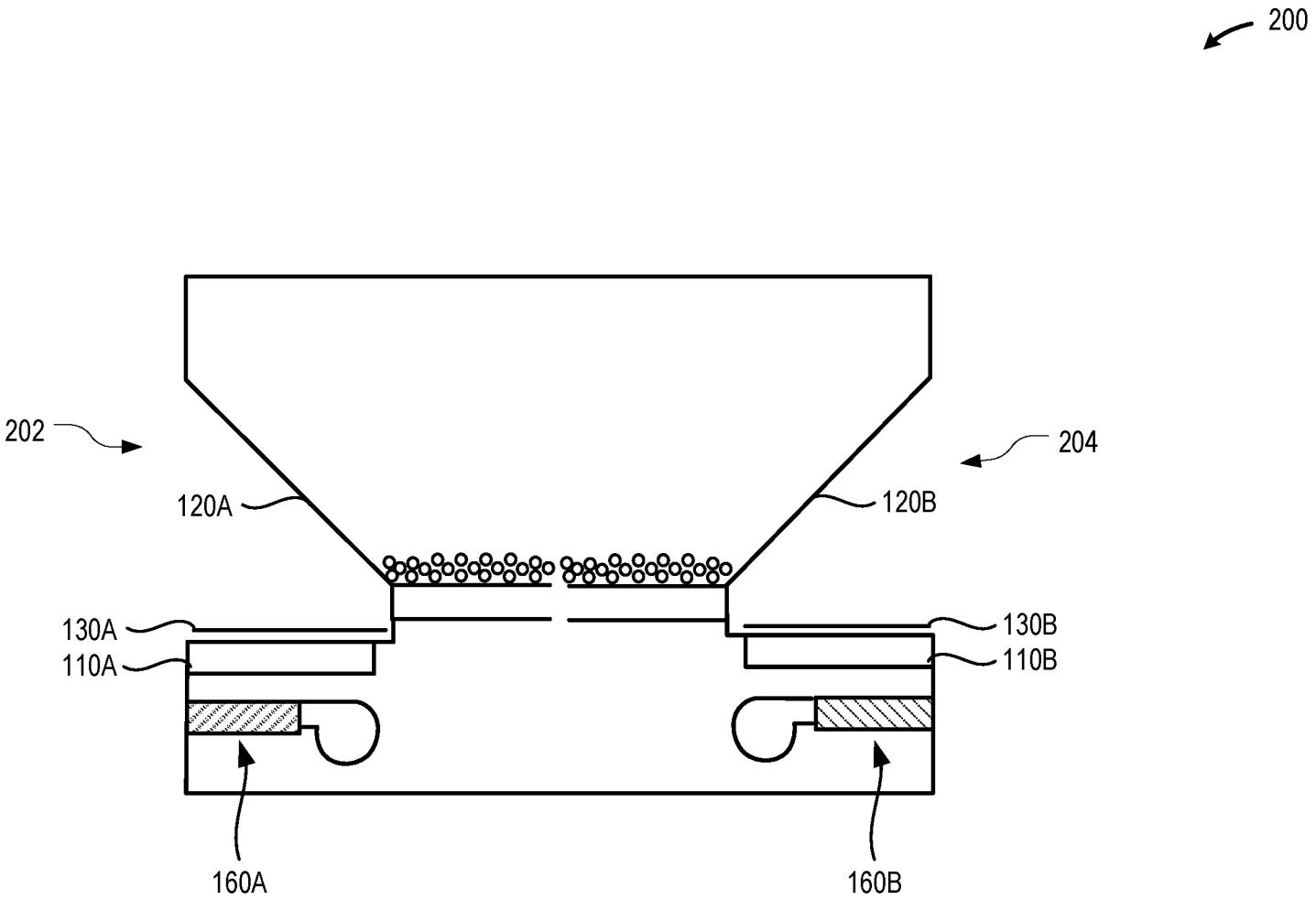
FIG. 2B is a transverse cross-sectional elevation of the illustrative two-sided electrically operated fireplace depicted in FIG. 2A, in accordance with at least one embodiment described herein.

FIG. 2A is an exploded perspective view of an illustrative two-sided electrically operated fireplace 200 that includes one or more first display panels 110A that provide a first planar display structure combined with one or more first reflective surfaces 120A that are arranged substantially parallel to one or more second display panels 110B that provide a second planar display structure combined with one or more second reflective surfaces 120B, in accordance with at least one embodiment described herein. FIG. 2B is a transverse cross-sectional elevation of the illustrative two-sided electrically operated fireplace 200 depicted in FIG. 2A, in accordance with at least one embodiment described herein.

As depicted in FIGS. 2A and 2B, the two-sided electrically operated fireplace 200 includes a first planar display structure and one or more first reflective surfaces 120A arranged back-to-back with a second planar display structure and one or more second reflective surfaces 120B. Using such an arrangement, the two-sided electrically operated fireplace 200 provides a flame effect visible from both sides 202, 204 (i.e., front and back) of the two-sided electrically operated fireplace 200. The one or more first display panels 110A, one or more first reflective surfaces 120A, and one or more filters 130A provide the flame effect visible on the first side 202 of the two-sided electrically operated fireplace 200. The one or more second display panels 110B, one or more second reflective surfaces 120B, and one or more second filters 130B provide the flame effect visible on the second side 204 of the two-sided electrically operated fireplace 200. In embodiments one or more substrate light sources 140 may be disposed between the one or more first reflective surfaces 120A and the one or more second reflective surfaces 120B. Substrate media 150 may be disposed on or about the one or more substrate light sources 140.

The illustrate example embodiment also includes first 160A and second 160B heating systems disposed on opposite sides of the two-sided electrically operated fireplace 200. Also as depicted in FIG. 2A, in embodiments, the end walls 174 and 176 may include an inner endwall 210 and an outer endwall 212. In embodiments, the inner end walls may include one or more grooves, detents, or similar surface features 214 to accept insertion of all or a portion of an edge of the one or more first reflective surfaces 120A and/or the one or more second reflective surfaces 120B.

Figure 3B:
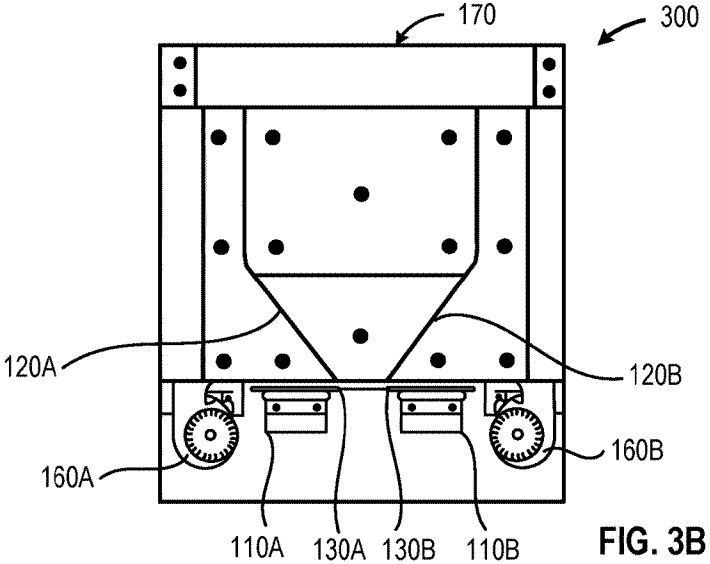
FIG. 3B is a cross-sectional end elevation of the peninsula style electrically operated fireplace depicted in FIG. 3A, along sectional line B-B, in accordance with at least one embodiment described herein.
Figure 3D:
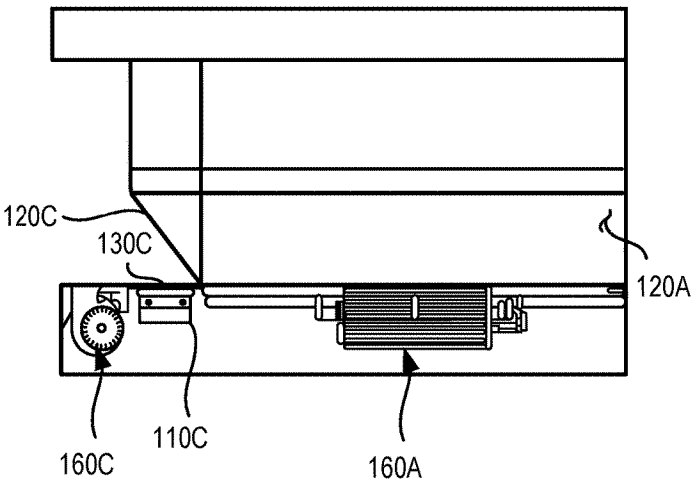
FIG. 3D is a cross-sectional side elevation of the illustrative peninsula style electrically operated fireplace depicted in FIG. 3C, along sectional line D-D, in accordance with at least one embodiment described herein.
Figure 3A:
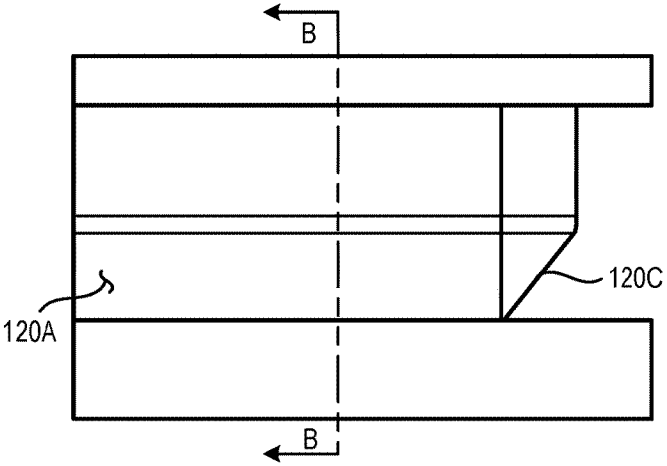
FIG. 3A is a side elevation of an illustrative peninsula style electrically operated fireplace in accordance with at least one embodiment described herein.
Figure 3C:
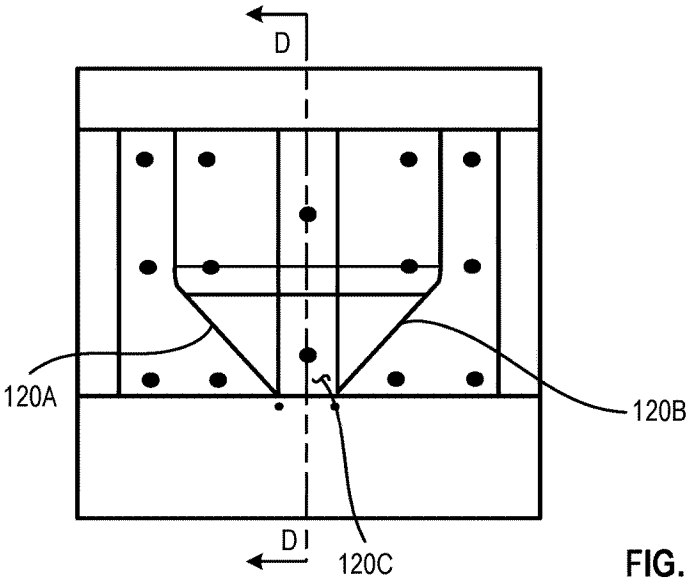
FIG. 3C is an end elevation of the illustrative peninsula style electrically operated fireplace depicted in FIG. 3A that more clearly depicts the one or more third reflective surfaces, in accordance with at least one embodiment described herein.

FIG. 3A is a side elevation of an illustrative peninsula style electrically operated fireplace 300 that may be viewed from a first side, a second side, and an end and in which one or more third display panels 110C that provide a third planar display structure combined with one or more third reflective surfaces 120C that are arranged substantially perpendicular to the one or more first display panels 110A that provide the first planar display structure combined with one or more first reflective surfaces 120A and substantially perpendicular to one or more second display panels 110B that provide a second planar display structure combined with one or more second reflective surfaces 120B, in accordance with at least one embodiment described herein. FIG. 3B is a cross-sectional end elevation of the peninsula style electrically operated fireplace 300 depicted in FIG. 3A, along sectional line B-B, in accordance with at least one embodiment described herein. FIG. 3C is an end elevation of the illustrative peninsula style electrically operated fireplace 300 depicted in FIG. 3A that more clearly depicts the one or more third reflective surfaces 120C, in accordance with at least one embodiment described herein. FIG. 3D is a cross-sectional side elevation of the illustrative peninsula style electrically operated fireplace 300 depicted in FIG. 3C, along sectional line D-D, in accordance with at least one embodiment described herein.

As depicted in FIGS. 3A-3D, in some embodiments, the electrically operated fireplace 300 may include a peninsula style design in which flames are visible from both sides and the end of the electrically operated fireplace 300. In such embodiments, one or more third display panels 110C and one or more third reflective surfaces 120C may be positioned to reflect flames from a first end of the electrically operated fireplace 300. One or more third filters 130C are disposed proximate the one or more third display panels 110C. In embodiments, the one or more third filters 130C may include one or more 4-way privacy filters to prevent viewers on either side of the electrically operated fireplace 300 from viewing the images displayed on the one or more third display panels 110C. In embodiments, a third heater assembly 160C may be disposed proximate the one or more third display panels 110C. In such embodiments, the third heater assembly 160C may discharge warm air from the end of the electrically operated fireplace 300.

Thus, the present disclosure is directed to systems and methods for providing an electrically operated fireplace that includes a one or more display panels, one or more reflective surfaces inclined at an angle with respect to the one or more display panels to reflect the video images of a flame displayed by the one or more display panels. One or more filters or privacy screens are disposed proximate the one or more display panels. Beneficially, the electrically operated fireplaces disclosed herein do not require the use of moving parts, such as a rotating mirror, to provide the images of the flames. Further, since video images are used to provide the flame effect, the flame effect may be varied simply by loading a new video image into the memory portion of the control circuitry used to provide the flame display. The control circuitry may include a simple CPU, such as a Raspberry Pi® or similar control circuitry.

The following examples pertain to various embodiments. The following examples of the present disclosure may comprise subject material such as at least one device, a method, at least one machine-readable medium for storing instructions that when executed cause a machine to perform acts based on the method of providing an electrically operated fireplace that includes one or more display panels and one or more reflective panels mounted at an angle with respect to the one or more display devices to provide a reflection of flame video images to observers on one to three sides of the fireplace.

According to example 1, there is provided an electrically operated fireplace system. The system may include: one or more first display panels aligned to form a first planar display structure; one or more first reflective panels, having at least one reflective surface disposed at an angle measured with respect to the first planar display structure, the at least one reflective surface to reflect at least a portion of an image displayed by the first planar display structure; one or more first filters disposed between the first planar display structure and the one or more first reflective panels, the one or more first filters to transmit incident visible light generated by the first planar display structure and perpendicular to the one or more first filters. The system may also include one or more first substrate light sources.

Example 2 may include elements of example 1 and the system may further include: a substrate material disposed proximate the substrate light source and proximate at least a portion of the one or more first reflective panels, the substrate material to diffuse the light emitted by the at least one substrate light source.

Example 3 may include elements of any of examples 1 or 2 and the system may further include: a first heater assembly to emit a flow of warm air in operation.

Example 4 may include elements of any of examples 1 through 3 where the one or more first display panels each include at least one of: at least one backlit liquid crystal display (LCD); at least one light emitting diode (LED) display; at least one organic light emitting diode (OLED) display; at least one polymer light emitting diode (PLED) display; or at least one quantum dot light emitting diode (QLED) display.

Example 5 may include elements of any of examples 1 through 4 and the system may further include: a housing having at least one surface with at least one aperture to view the at least one reflective panel from a location external to the electrically operated fireplace.

Example 6 may include elements of any of examples 1 through 5 where the housing further includes a back panel disposed transversely across a width of the housing from the one or more first reflective panels such that a line-of-sight exists through the electrically operated fireplace system.

Example 7 may include elements of any of examples 1 through 6 where each of the one or more first reflective panels comprise a tinted transparent panel.

Example 8 may include elements of any of examples 1 through 7 where each of the one or more first reflective panels comprise a glass reflective panel.

Example 9 may include elements of any of examples 1 through 8 where each of the one or more first reflective panels comprise at least one of: an acrylic reflective panel or a polycarbonate reflective panel.

Example 10 may include elements of any of examples 1 through 9 where the one or more first substrate light source comprises one or more light emitting diode (LED) light sources.

Example 11 may include elements of any of examples 1 through 10 and the system may further include: one or more second display panels that form a second planar display structure, the second display structure spaced-apart from the first display structure; one or more second reflective panels having a second reflective surface disposed at an angle measured with respect to the second planar display structure, the at least one reflective surface to reflect at least a portion of an image displayed by the second planar display structure; one or more second filters disposed between the second planar display structure and the and the one or more second reflective panels, the one or more second filters to transmit incident visible light perpendicular to the one or more second filters. In some embodiments the second planar display structure may be substantially parallel to and substantially co-planar to the first display structure. In some embodiments the system may also include one or more second substrate light sources.

Example 12 may include elements of any of examples 1 through 11 and the system may further include: a second heater assembly to emit a flow of warm air proximate the one or more second reflective panels in operation.

Example 13 may include elements of any of examples 1 through 12 where the one or more second display panels each include at least one of: at least one backlit liquid crystal display (LCD); at least one light emitting diode (LED) display; at least one organic light emitting diode (OLED)

display; at least one polymer light emitting diode (PLED) display; or at least one quantum dot light emitting diode (QLED) display.

Example 14 may include elements of any of examples 1 through 13 and the system may further include: a housing that includes: a first surface with at least one aperture to view the one or more first reflective panels from a location external to the electrically operated fireplace; and a second surface with at least one aperture to view the one or more second reflective panels from a location external to the electrically operated fireplace.

Example 15 may include elements of any of examples 1 through 14 where the one or more second substrate light sources comprise one or more light emitting diode (LED) light sources.

Example 16 may include elements of any of examples 1 through 15 and the system may further include: one or more third display panels that form a third planar display structure, the third display structure disposed substantially perpendicular to the first planar display structure and substantially perpendicular to the second planar display structure; one or more third reflective panels having a third reflective surface disposed at an angle measured with respect to the third planar display structure, the one or more third reflective panels to reflect at least a portion of an image displayed by the third planar display structure, a first end of the one or more third reflective panels disposed proximate the one or more first reflective panels and a second end of the one or more third reflective panels disposed proximate the one or more second reflective panels; one or more third filters disposed between the third planar display structure and the and the one or more third reflective panels, the one or more third filters to transmit incident visible light perpendicular to the one or more third filters. In some embodiments the third planar display structure may be substantially co-planar to the first display structure and the second display structure. In some embodiments the system may also include one or more third substrate light sources Example 17 may include elements of any of examples 1 through 16 where the one or more third display panels each include at least one of: at least one backlit liquid crystal display (LCD); at least one light emitting diode (LED) display; at least one organic light emitting diode (OLED) display; at least one polymer light emitting diode (PLED) display; or at least one quantum dot light emitting diode (QLED) display.

Example 18 may include elements of any of examples 1 through 17 where the one or more third reflective panels comprise one or more curved third reflective panels.

Example 19 may include elements of any of examples 1 through 18 and the system may further include: a housing that includes: a first surface with at least one aperture to view the one or more first reflective panels from a location external to the electrically operated fireplace; a second surface with at least one aperture to view the one or more second reflective panels from a location external to the electrically operated fireplace; and a third surface with at least one aperture to view the one or more third reflective panels from a location external to the electrically operated fireplace.

Example 20 may include elements of any of examples 1 through 19 where the one or more third substrate light sources comprise one or more light emitting diode (LED) light sources As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

As used in any embodiment herein, the terms "system" or "module" may refer to, for example, software, firmware and/or circuitry configured to perform any of the aforementioned operations. Software may be embodied as a software package, code, instructions, instruction sets and/or data recorded on non-transitory computer readable storage mediums. Firmware may be embodied as code, instructions or instruction sets and/or data that are hard-coded (e.g., non-volatile) in memory devices.

As used in any embodiment herein, the term "circuitry" may comprise, for example, singly or in any combination, hardwired circuitry, programmable circuitry such as computer processors comprising one or more individual instruction processing cores, state machine circuitry, and/or firmware that stores instructions executed by programmable circuitry or future computing paradigms including, for example, massive parallelism, analog or quantum computing, hardware embodiments of accelerators such as neural net processors and non-silicon implementations of the above. The circuitry may, collectively or individually, be embodied as circuitry that forms part of a larger system, for example, an integrated circuit (IC), system on-chip (SoC), desktop computers, laptop computers, tablet computers, servers, smartphones, etc.

Any of the operations described herein may be implemented in a system that includes one or more mediums (e.g., non-transitory storage mediums) having stored therein, individually or in combination, instructions that when executed by one or more processors perform the methods. Here, the processor may include, for example, a server CPU, a mobile device CPU, and/or other programmable circuitry. Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), embedded multimedia cards (eMMCs), secure digital input/output (SDIO) cards, magnetic or optical cards, or any type of media suitable for storing electronic instructions. Other embodiments may be implemented as software executed by a programmable control device.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems. The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection.

Spatially relative terms, such as "beneath," below," upper," "lower," "above", "top", "bottom", "front", "back" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as the "top" would then be oriented as the "bottom". Thus, the exemplary term "top" can encompass both an orientation of top and bottom. The device may be otherwise oriented (rotated 90 degrees or at other orientations) and the spatially relative descriptors used herein interpreted accordingly.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed:

1. An electrically operated fireplace system, comprising:

one or more first display panels aligned to form a first planar display structure;

one or more second display panels that form a second planar display structure, the second display structure spaced-apart from the first display structure;

one or more first reflective panels, having at least one reflective surface disposed at an angle measured with respect to the first planar display structure, the at least one reflective surface to reflect at least a portion of an image displayed by the first planar display structure;

one or more second reflective panels having a second reflective surface disposed at an angle measured with respect to the second planar display structure, the at least one reflective surface to reflect at least a portion of an image displayed by the second planar display structure;

one or more first filters disposed between the first planar display structure and the one or more first reflective panels, the one or more first filters to transmit incident visible light generated by the first planar display structure and perpendicular to the one or more first filters; and one or more second filters disposed between the second planar display structure and the and the one or more second reflective panels, the one or more second filters to transmit incident visible light perpendicular to the one or more second filters.

2. The system of claim 1, further comprising one or more first substrate light sources.

3. The system of claim 2 wherein the one or more first substrate light sources comprise one or more light emitting diode (LED) light sources.

4. The system of claim 2, further comprising:

a substrate material disposed proximate the substrate light source and proximate at least a portion of the one or more first reflective panels, the substrate material to diffuse the light emitted by the at least one substrate light source.

5. The system of claim 2, further comprising one or more second substrate light sources.

6. The system of claim 1, further comprising:

a first heater assembly to emit a flow of warm air in operation.

7. The system of claim 6, further comprising:

a second heater assembly to emit a flow of warm air proximate the one or more second reflective panels in operation.

8. The system of claim 1 wherein the one or more first display panels each include at least one of: at least one backlit liquid crystal display (LCD); at least one light emitting diode (LED) display; at least one organic light emitting diode (OLED) display; at least one polymer light emitting diode (PLED) display; or at least one quantum dot light emitting diode (QLED) display.

9. The system of claim 8 wherein the one or more second display panels each include at least one of: at least one backlit liquid crystal display (LCD); at least one light emitting diode (LED) display; at least one organic light emitting diode (OLED) display; at least one polymer light emitting diode (PLED) display; or at least one quantum dot light emitting diode (QLED) display.

10. The system of claim 1, further comprising:

a housing having at least one surface with at least one aperture to view the at least one or more first reflective panels from a location external to the electrically operated fireplace.

11. The system of claim 10 wherein the housing further includes a back panel disposed transversely across a width of the housing from the one or more first reflective panels such that a line-of-sight exists through the electrically operated fireplace system.

12. The system of claim 1 wherein each of the one or more first reflective panels comprise a tinted transparent panel.

13. The system of claim 1 wherein each of the one or more first reflective panels comprise a glass reflective panel.

14. The system of claim 1 wherein each of the one or more first reflective panels comprise at least one of: an acrylic reflective panel or a polycarbonate reflective panel.

15. The system of claim 1, further comprising:

a housing that includes:

a first surface with at least one aperture to view the one or more first reflective panels from a location external to the electrically operated fireplace; and a second surface with at least one aperture to view the one or more second reflective panels from a location external to the electrically operated fireplace.

16. The system of claim 1, further comprising:

one or more third display panels that form a third planar display structure, the third display structure disposed substantially perpendicular to the first planar display structure and substantially perpendicular to the second planar display structure;

one or more third reflective panels having a third reflective surface disposed at an angle measured with respect to the third planar display structure, the one or more third reflective panels to reflect at least a portion of an image displayed by the third planar display structure, a first end of the one or more third reflective panels disposed proximate the one or more first reflective panels and a second end of the one or more third reflective panels disposed proximate the one or more second reflective panels;

one or more third filters disposed between the third planar display structure and the and the one or more third reflective panels, the one or more third filters to transmit incident visible light perpendicular to the one or more third filters.

17. The system of claim 16 wherein the one or more third display panels each include at least one of: at least one backlit liquid crystal display (LCD); at least one light emitting diode (LED) display; at least one organic light emitting diode (OLED) display; at least one polymer light emitting diode (PLED) display; or at least one quantum dot light emitting diode (QLED) display.

18. The system of claim 16 wherein the one or more third reflective panels comprise one or more curved third reflective panels.

19. The system of claim 16, further comprising:

a housing that includes:

a first surface with at least one aperture to view the one or more first reflective panels from a location external to the electrically operated fireplace;

a second surface with at least one aperture to view the one or more second reflective panels from a location external to the electrically operated fireplace; and a third surface with at least one aperture to view the one or more third reflective panels from a location external to the electrically operated fireplace.

* * * * *